US008146963B2

(12) United States Patent
Wyslucha

(10) Patent No.: US 8,146,963 B2
(45) Date of Patent: Apr. 3, 2012

(54) RELEASABLE MOUNTING OF AN ACCESSORY ON AN OPERATING TABLE

(75) Inventor: Ulrich Wyslucha, Weingarten (DE)

(73) Assignee: Maquet GmbH & Co. KG, Rastatt (DE)

( * ) Notice: Subject to any disclaimer, the term of this patent is extended or adjusted under 35 U.S.C. 154(b) by 393 days.

(21) Appl. No.: 12/519,635

(22) PCT Filed: Dec. 17, 2007

(86) PCT No.: PCT/EP2007/064045

§ 371 (c)(1),
(2), (4) Date: Oct. 13, 2009

(87) PCT Pub. No.: WO2008/074766

PCT Pub. Date: Jun. 26, 2008

(65) Prior Publication Data

US 2010/0031446 A1 Feb. 11, 2010

(30) Foreign Application Priority Data

Dec. 18, 2006 (DE) ..... 10 2006 059 733

(51) Int. Cl.

| | |
|---|---|
| ***E05C 1/04*** | (2006.01) |
| *E05C 9/10* | (2006.01) |
| *E05C 1/02* | (2006.01) |
| *A47C 21/00* | (2006.01) |
| *A47C 31/00* | (2006.01) |
| *A47B 7/00* | (2006.01) |

(52) U.S. Cl. ..... 292/150; 292/37; 292/145; 292/137; 5/503.1; 5/658; 5/621

(58) Field of Classification Search ..... 5/621, 622, 5/623, 624, 635, 658, 503.1; 292/145, 150, 292/137, DIG. 37

See application file for complete search history.

(56) References Cited

U.S. PATENT DOCUMENTS

| | | | |
|---|---|---|---|
| 5,754,997 | A | 5/1998 | Pennington et al. |
| 2002/0170115 | A1 | 11/2002 | Borders et al. |
| 2006/0117484 | A1 | 6/2006 | Derenne et al. |

OTHER PUBLICATIONS

International Search Report for PCT/EP2007/064045 dated Apr. 9, 2008.

*Primary Examiner* — Jonathan Liu

(74) *Attorney, Agent, or Firm* — McCormick, Paulding & Huber LLP

(57) ABSTRACT

What is described is a device for releasable mounting an accessory (12) on an operating table (102), comprising two coupling parts (10, 100) which can be connected to each other and a mechanism for locking and unlocking. The mechanism comprises a first locking element (26) arranged on the first coupling part (10) and a second locking element (114) arranged on the second coupling part (100), an unlocking element (28) arranged on the first coupling part (10) which is biased into a locking position and can be moved into an unlocking position against the biasing, in which unlocking position it acts on one (114) of the two locking elements (26, 114) such that the two locking elements (26, 114) are disengaged from one another, a catch element (40) which is arranged on the first coupling part (10) and keeps the unlocking element (28) in its unlocking position against the biasing, and a release element (46) arranged on the first coupling part (10) which is biased into a first position and is acted upon by the second coupling part (100) when the coupling parts (10, 100) are connected to each other and is pushed into the second position against the biasing. The release element (46) acts on the catch element (40) in its first position such that the same is disengaged from the unlocking element (28).

12 Claims, 6 Drawing Sheets

RELEASABLE MOUNTING OF AN ACCESSORY ON AN OPERATING TABLE

CROSS REFERENCE TO RELATED APPLICATION

This application is entitled to the benefit of and incorporates by reference essential subject matter disclosed in International Patent Application No. PCT/EP2007/064045 filed on Dec. 17, 2007 and German Patent Application No. 10 2006 059 733.8 filed Dec. 18, 2006.

TECHNICAL FIELD

The invention relates to a device for releasable mounting of an accessory on an operating table, comprising two coupling parts which can be connected to each other, a first one of which is arranged on the accessory and a second one of which is arranged on the operating table, and a mechanism for locking and unlocking the connection between the two coupling parts.

BACKGROUND OF THE INVENTION

Usually, operating table systems have devices for releasable mounting of an accessory on, for example, a leg or back plate or an extension unit, by means of which broken bone parts are kept apart during the operation. Such a device comprises two coupling parts. One of these coupling parts is arranged on the accessory, while the other is mounted on the operating table. The two coupling parts can be connected to each other and thus form a mechanical interface for mounting the accessory on the operating table.

For securing the accessory, the connection between the two coupling parts has to be locked. This can be effected by a frictional connection, in that a locking element is actuated, for example, in that a knurled screw is tightened or an eccentric lever is thrown. This type of locking bears the risk that the operator forgets to actuate the locking element, and that the accessory inadvertently disengages from the operating table. In addition, it often happens that the locking element is not actuated with sufficient force so that only an insufficient frictional connection is established. In this case, too, the accessory can inadvertently disengage from the operating table.

A locking of the connection between the two coupling parts can also be effected by a positive locking. One example of such a positive locking is an arrangement in which a pin which is resiliently mounted on the one coupling part automatically engages the bore arranged on the other coupling part when the two coupling parts are connected to each other. Such a locking has the advantage that the operator is not obliged to actively actuate a locking element. There is further no risk that the operator forgets the locking operation. In order to remove the accessory from the operating table, the operator has to release the positive locking between the pin and the bore, i.e. unlock the connection between the two coupling parts.

For this purpose, mechanisms are known in which the operator actuates a corresponding element, for example, a push button or a spring-loaded lever, for unlocking. In this case, the connection is only unlocked for as long as the operator actuates the unlocking element.

Other mechanisms function such that one of two possible states, namely a locking state and an unlocking state, is assumed by actuation of an element, and this state is maintained for as long as this element is actuated again. Here, too, however, there is the risk that the operator forgets to reactivate the locking once he/she has unlocked the connection and, for example, exchanged the accessory. Moreover, since the operator has to activate the mechanism not only for unlocking but also for locking of the connection, the handling is comparatively time-consuming.

Conventional unlocking and locking mechanisms are problematic with respect to their handling in particular when the accessory has to be mounted and secured at two mechanical interfaces, as this is, for example, the case given a wide leg plate, on which both legs of the patient are to be rested at the same time and which is thus fixed at two points on the operating table. When the distance between these two points is so great that the operator cannot reach these points simultaneously with both hands, then removing of the accessory is particularly difficult. This also applies to the case where the accessory is comparatively bulky or heavy. Given such an accessory the removal from the operating table is already difficult when only one single mechanical interface is provided. In this case, for removing the accessory, it has to be grabbed near its center of gravity or at two points lying apart from one another as far as possible, since otherwise the accessory is levered out of the hands of the operator and thus there is no longer a possibility of unlocking.

Usually, an unlocking of the connection between the two coupling parts is only possible directly at the interface itself. A remote actuation or a coupled actuation of two interfaces is normally not possible. The reasons for this are space problems, cost considerations or operation-specific circumstances, such as the occurrence of disturbing contours in x-ray applications. In this case, the unlocking elements cannot be arranged at points which form ergonomically favorable points of application.

BRIEF SUMMARY OF THE INVENTION

It is the object of the invention to specify a device for releasable mounting of an accessory on an operating table which is particularly easy to handle with respect to the locking and unlocking of the connection between the two coupling parts.

This object is solved by the invention in that the mechanism for locking and unlocking of the connection between the two coupling parts comprises:

- a first locking element arranged at the first coupling part and a second locking element arranged at the second coupling part, which can be engaged with one another for locking and can be disengaged from one another for unlocking,
- a manually actuatable unlocking element movably arranged at the first coupling part, which unlocking element is biased into a locking position and can be moved against the biasing into an unlocking position in which it acts on one of the two locking elements such that the two locking elements are disengaged from one another,
- a catch element which is movably arranged at the first coupling part and keeps the unlocking element in its unlocking position against the biasing, and
- a release element which is movably arranged at the first coupling part, is biased into a first position and is acted upon by the second coupling part when the coupling parts are connected to each other and pushed into a second position against the biasing,
- the release element acting on the catch element in its first position such that the catch element (40) is disengaged from the unlocking element.

In the inventive device, three different states are to be considered, namely a locked and an unlocked state when the coupling parts are connected to each other as well as a ready-to-lock state given disengaged coupling parts.

In the locked state and with the coupling parts being connected to each other, the two locking elements are engaged with one another. Moreover, the unlocking element is placed in the locking position by means of its mechanical biasing and the release element is pushed into its second position by the second coupling part. In the second position, the release element does not act on the catch element.

In the unlocked state and with the coupling parts being connected to each other, the unlocking element is moved into the unlocking position against its mechanical biasing, as a result whereof it acts upon one of the two locking elements such that the two locking elements are disengaged from one another.

In the ready-to-lock state and with the coupling parts being disconnected from one another, the release element is placed in the first position by its mechanical biasing. In this first position the release element acts on the catch element such that the latter is disengaged from the unlocking element. This means that the catch element does no longer act on the unlocking element, and the latter is placed in the locking position by its mechanical biasing. When the two coupling parts are again connected to each other in this state, then the connection is locked.

The invention makes it possible to separate the unlocking and the removal of the two coupling parts locally and temporally. The unlocking is effected via the unlocking element which is moved into its unlocking position in order to act upon one of the two locking elements and thus to disengage the two locking elements. Independent of this unlocking operation, then the two coupling parts can be disconnected from one another in that the operator grabs the accessory at points which are ergonomically favorable for this. From this point of view, the invention can be used particularly advantageously when several mechanical interfaces for mounting the accessory on the operating table are provided. One inventive device is provided for each of these interfaces. First of all, these devices can be successively unlocked. Thereafter, two connected coupling parts each can be disconnected from one another.

The inventive device has in particular the advantage that it is always ready to be locked given disconnected coupling parts. This is ensured by the release element which renders the effect of the catch element, namely to keep the unlocking element in its unlocking position, ineffective given disconnected coupling parts. As soon as the two coupling parts are disconnected from one another, the inventive device is automatically transferred into the ready-to-lock state. Thus, no additional manipulation is necessary in order to establish this ready-to-lock state. In particular, there is no risk that the restoration of this state might be forgotten. This considerably facilitates the handling.

In an advantageous embodiment, the first locking element is a bore and the second locking element is a movably mounted pin which is resiliently biased via a first biasing element such that it engages the bore when the coupling parts are connected to each other. The biasing element is, for example, a pressure-loaded coil spring. In this embodiment the bore and the pin received therein establish a positive locking that requires little technical expense but is nevertheless reliable.

In a further embodiment, the unlocking element is slidably mounted in the bore, resiliently biased into the locking position via a second biasing element and has an externally actuatable push button at its end opposite to the pin and a shaft at its end facing the pin which upon actuation of the push button pushes the pin out of the bore. The second biasing element can again be formed as a pressure-loaded spring. By pushing the push button against the spring force exerted by this coil spring, the shaft of the unlocking element abuts on the pin engaging the bore and pushes the same out of the bore. As a result thereof, the positive locking is released.

An advantageous development of the inventive device consists in that the push button is substantially formed as a hollow cylinder, the end of which facing the pin being open and the end of which opposite to the pin being closed, in that the outer surface of the hollow cylinder has an annular groove perpendicular to the cylinder axis and in that the catch element is mounted immovably parallel to the cylinder axis and mounted movably perpendicular to the cylinder axis. Further, the catch element is resiliently biased via a third biasing element onto the outer surface of the hollow cylinder, and is engaged in the groove in the unlocking position of the unlocking element. In that the third biasing element, for example a pressure-loaded coil spring, presses the catch element onto the outer surface of the hollow cylinder, it engages the groove formed in the outer surface of the hollow cylinder when the push button is actuated for unlocking. By means of the catch element being engaged in the groove, the unlocked state is maintained for as long as the catch element is again disengaged from the groove.

In a further embodiment, the release element is a bolt which is movable parallel to the cylinder axis and has a bearing surface inclined with respect to the cylinder axis and formed such that, when the unlocking element is engaged in the groove, it abuts on the catch element during the movement of the release element from its second position into its first position and thus disengages the catch element from the groove. The movement of the bolt forming the release element which movement is parallel to the cylinder axis, is thus converted by the inclined bearing surface into a movement of the catch element perpendicular to the cylinder axis, as a result whereof the catch element is disengaged from the groove. The coupling of these two movements which are perpendicular to each other, allows a particularly compact structure of the mechanism for locking and unlocking.

This compactness can still be increased in that the catch element has a recess parallel to the cylinder axis through which the release element is passed, and in that the bearing surface of the release element abuts on a part of the wall of the recess. In that the release element is passed through the recess, in particular the required space for the mechanism perpendicular to the cylinder axis of the hollow cylinder forming the push button is reduced.

In a further advantageous embodiment, the catch element has an externally accessible actuating section, via which the catch element engaged in the groove can be manually disengaged from the groove. In this embodiment, the operator can release the unlocked state once established by actuation of the push button when the coupling parts are connected to each other in that he/she manually disengages the catch element from the groove. As a result thereof, the unlocking element is again moved into the locking position by the force exerted by the second biasing element and the connection is locked. Thus, an emergency locking is possible, as a result whereof the safety is increased.

The first coupling part is, for example, formed such that it has a box-shaped body which is open on one side and accommodates the second coupling part. As a result thereof, the device has a particularly compact structure.

A further advantageous embodiment provides that the first coupling part has a rod extending between opposite sidewalls in the upper region of the body, that the second coupling part has a rod receptacle on its upper surface into which the first coupling part with its rod can be fitted such that it can be pivoted in the receptacle and that the bore forming the first locking element is arranged in the lower region of the body and the pin forming the second locking element is arranged in the lower region of the second coupling part. In this embodiment, for mounting the accessory on the operating table at first the first coupling part is fitted on the second coupling part from above and then placed on the second coupling part in a pivot motion, the pivot axis of which is given by the rod fitted into the rod receptacle. As a result thereof, the bore forming the first locking element and the pin forming the second locking element, each of which being arranged in the lower region of the respective coupling part, are pivoted towards one another and brought into contact.

An advantageous development provides that the bore forming the first locking element is formed in a sidewall of the first coupling part and that a portion of the sidewall bordering the bore towards the open side of the body has a beveled sliding surface for the pin of the second coupling part sliding into the bore. The beveled sliding surface ensures that the pin moved along the sliding surface is so to speak contracted against the force exerted by the first biasing element in order to then extend into the bore by this force, i.e. to engage therein. Thus, the connection can be softly locked without tilting of the resiliently mounted pin.

The release element is preferably movably mounted in a further bore formed in the sidewall of the body of the first coupling part and is resiliently biased via a fourth biasing element, for example a pressure-loaded coil spring, such that it projects from the sidewall into the interior of the body. When the coupling parts are connected to each other, the release element is then pushed into its second position from a sidewall of the second coupling part. Accordingly, the release element cooperates with the second coupling part such that it is rendered ineffective by the latter with respect to the catch element when the coupling parts are connected to each other, while it acts on the catch element and disengages the same from the groove when the second coupling element does not act upon it.

In an advantageous development, the portion of the release element projecting into the interior of the body of the first coupling part in the first position has a tapered form. This guarantees that the release element is softly contracted into the further bore formed in the sidewall of the body of the first coupling part, when the afore-mentioned sidewall of second coupling part comes into contact with the release element.

BRIEF DESCRIPTION OF THE DRAWINGS

In the following, the invention is described on the basis of a preferred embodiment with reference to the figures.

DETAILED DESCRIPTION OF THE INVENTION

In FIGS. 1 to 7 a preferred embodiment of the inventive device is illustrated, however, the invention is not restricted to this embodiment.

Figure 1:
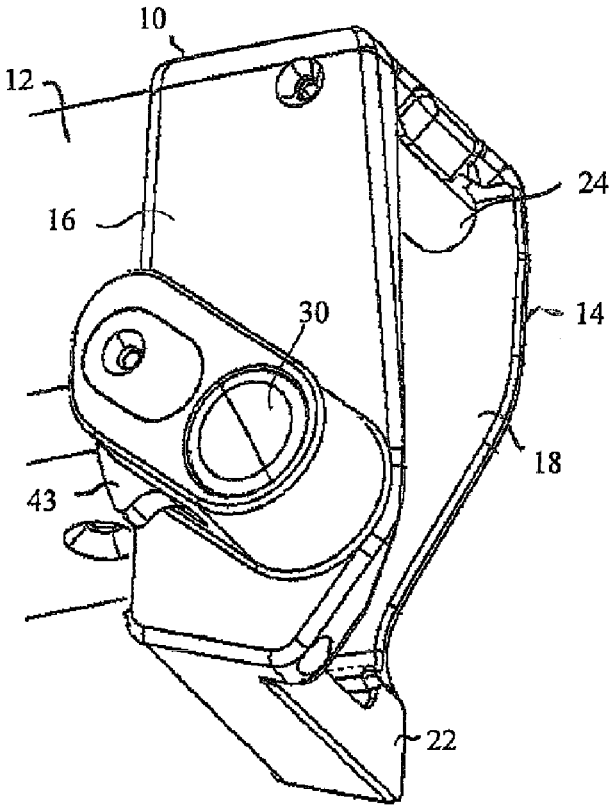
FIGS. 1 and 2 are perspective views of the first coupling part.
Figure 2:
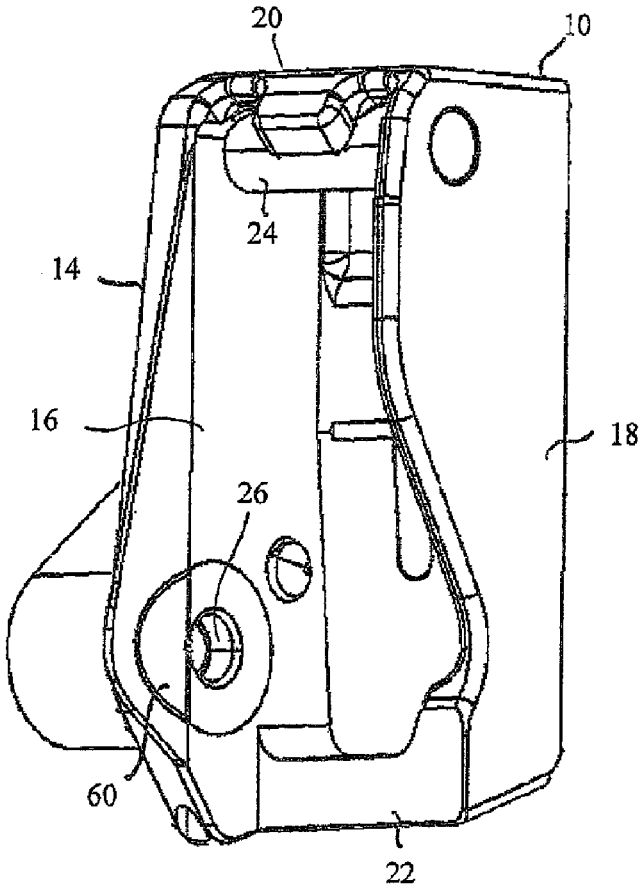
Figure 3:
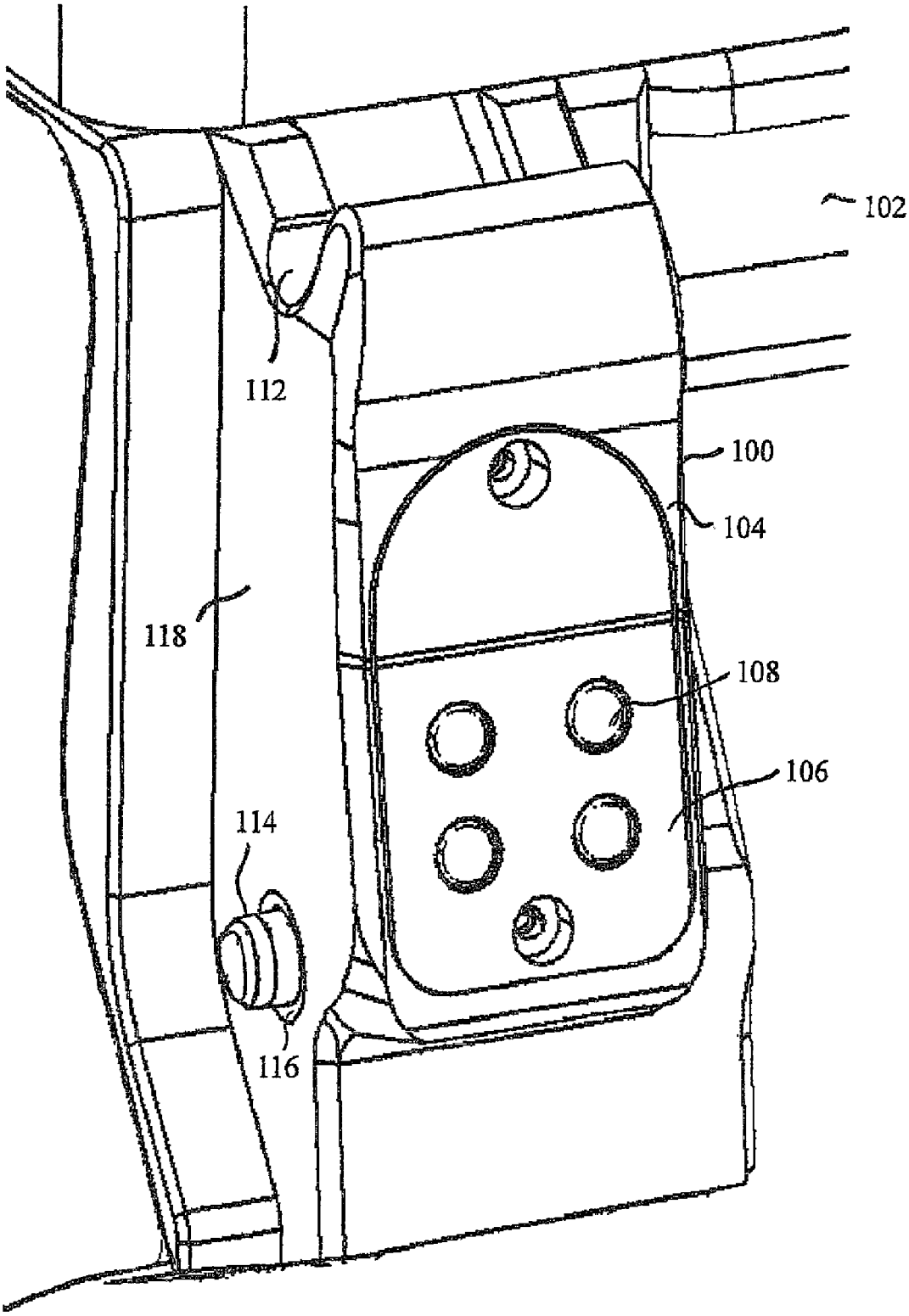
FIG. 3 is a perspective view of the second coupling part.

The device comprises a first coupling part 10 illustrated in FIGS. 1 and 2 and a second coupling part 100 illustrated in FIG. 3. The first coupling part 10 is arranged on an accessory 12, only a little part of which is shown in FIG. 1 and which is not shown at all in FIG. 2. Examples of such an accessory are a leg plate, a back plate or an extension unit of the type explained at the beginning. The first coupling part 10 can be integrally formed with the accessory 12, or can be mounted thereto by means of suitable mounting means such as screws.

The second coupling part 100 is arranged on an operating table 102, again only a little portion of which is shown in FIG. 3. The second coupling part 100 can again be integrally formed with the operating table 102 or can be mounted thereto by means of suitable mounting means such as screws. Preferably, the second coupling part 100 is arranged on a lateral face of the operating table 102.

The device comprising the two coupling parts 10 and 100 forms a mechanical interface for releasable mounting of the accessory 12 on the operating table 102. In this connection, it is particularly pointed out that the accessory 12 can have several coupling parts 10. In this case, the operating table 102, too, has several coupling parts 100 so that the accessory 12 is mounted on the operating table 102 via several mechanical interfaces.

In this embodiment, the first coupling part 10 has a box-shaped body 14 which is open on one side. The body 14 is formed of two sidewalls 16 and 18, a top wall 20 and a bottom wall 22.

The second coupling part 100 is formed such that it can be received in the box-shaped body 14 of the first coupling part 10. This means that the two coupling parts 10 and 100 have a largely complementary shape with respect to one another.

In the embodiment of the second coupling part 100 shown in FIG. 3, a connecting panel 106 is located on an end face 104. This connecting panel 106 comprises several contacts 108.

As shown in FIGS. 1 and 2, in the upper region of the body 14 of the first coupling part 10 there is a rod 24 extending between the two opposite sidewalls 16 and 18. As shown in FIG. 3, the second coupling part 100 has on its upper surface a rod receptacle 112 adapted to the rod 24. The rod 24 and the rod receptacle 112 are provided for connecting the two coupling parts to each other, as will be explained in more detail further below.

In the following a mechanism is described which serves to lock and unlock the connection between the two coupling parts 10 and 100. This mechanism includes both components formed on the first coupling part 10 as well as components formed on the second coupling part 100.

Figure 5:
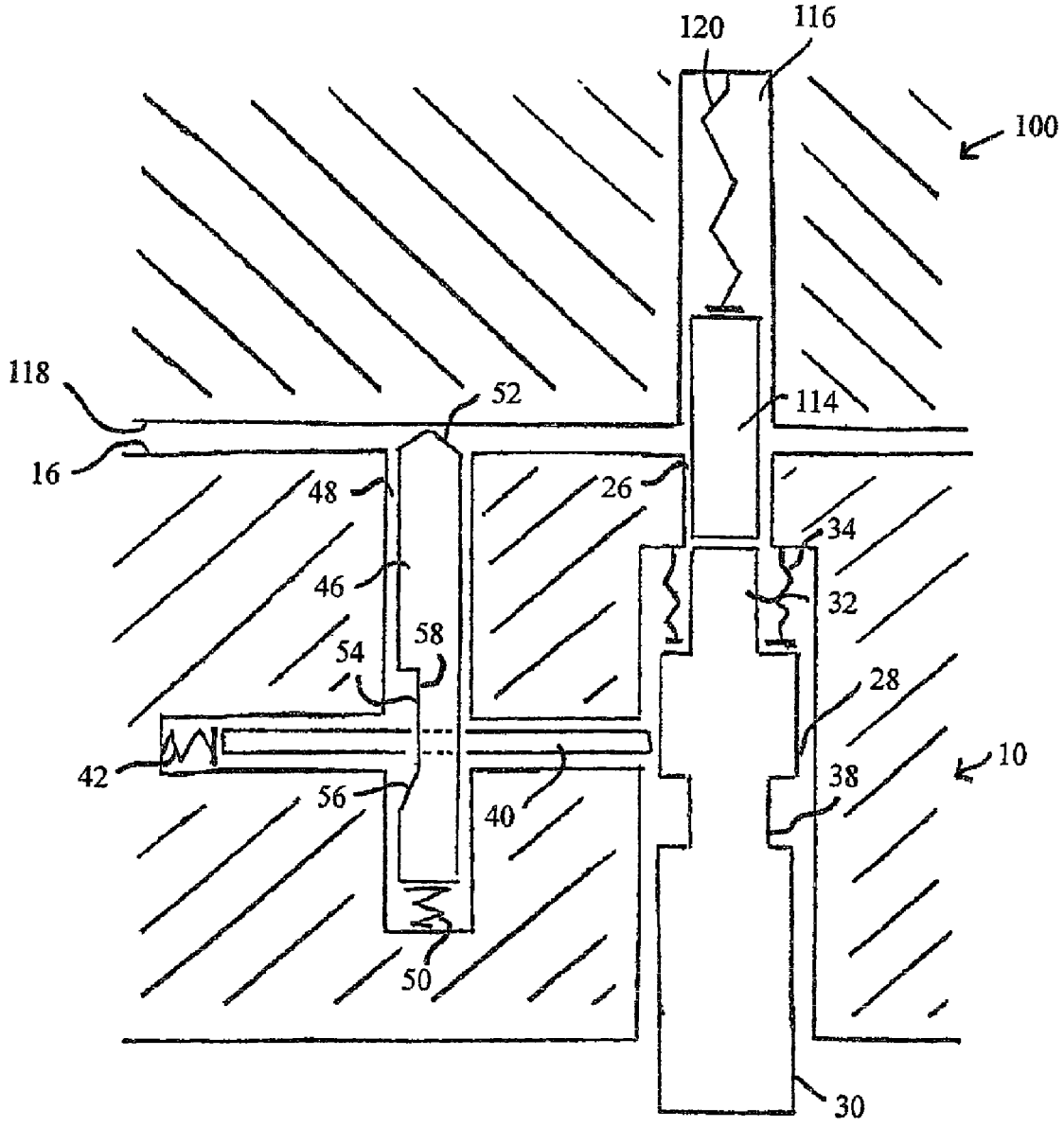
FIG. 5 is a schematic illustration of the inventive device in the locked state.
Figure 6:
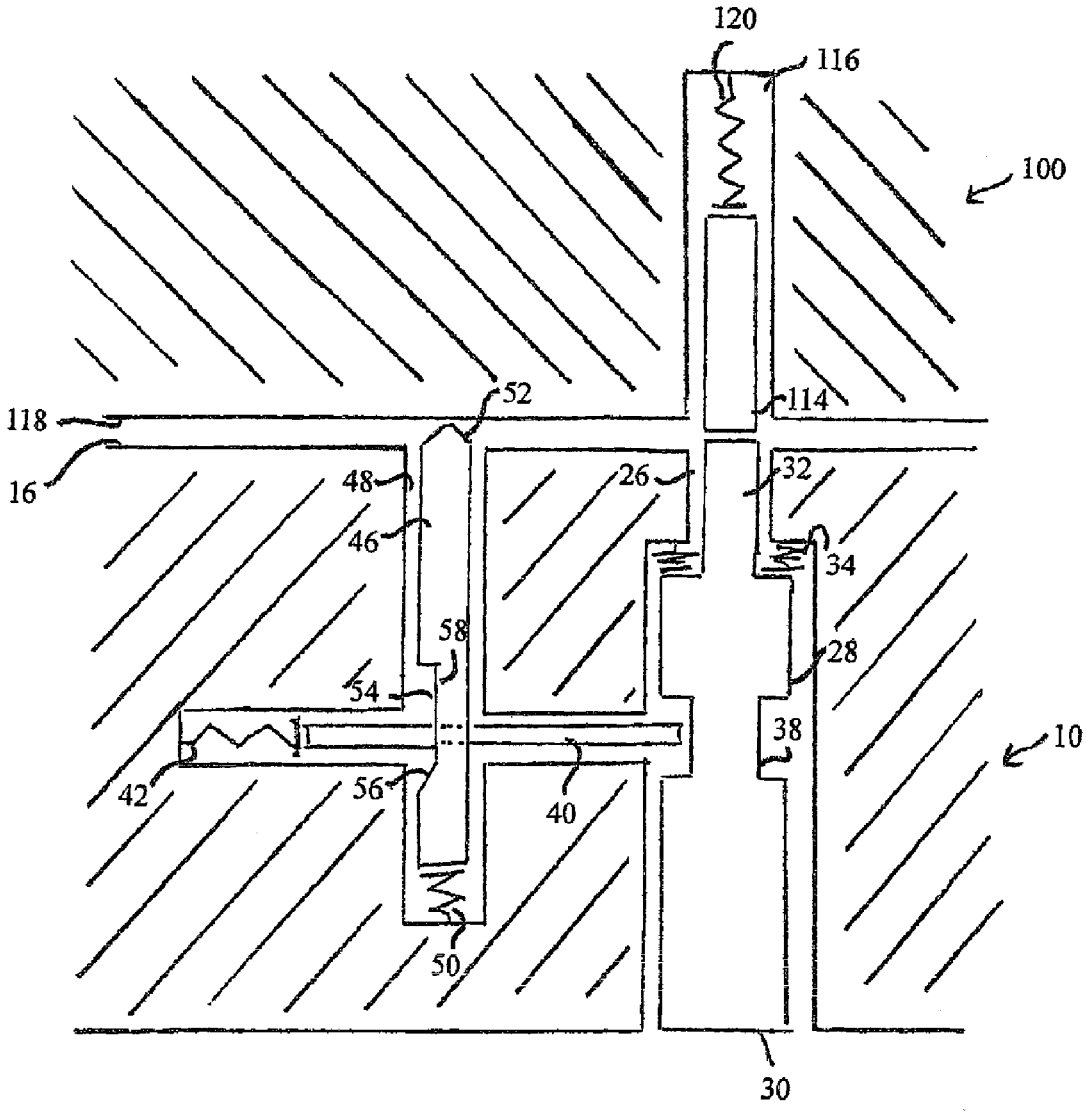
FIG. 6 is a schematic illustration of the inventive device in the unlocked state.
Figure 7:
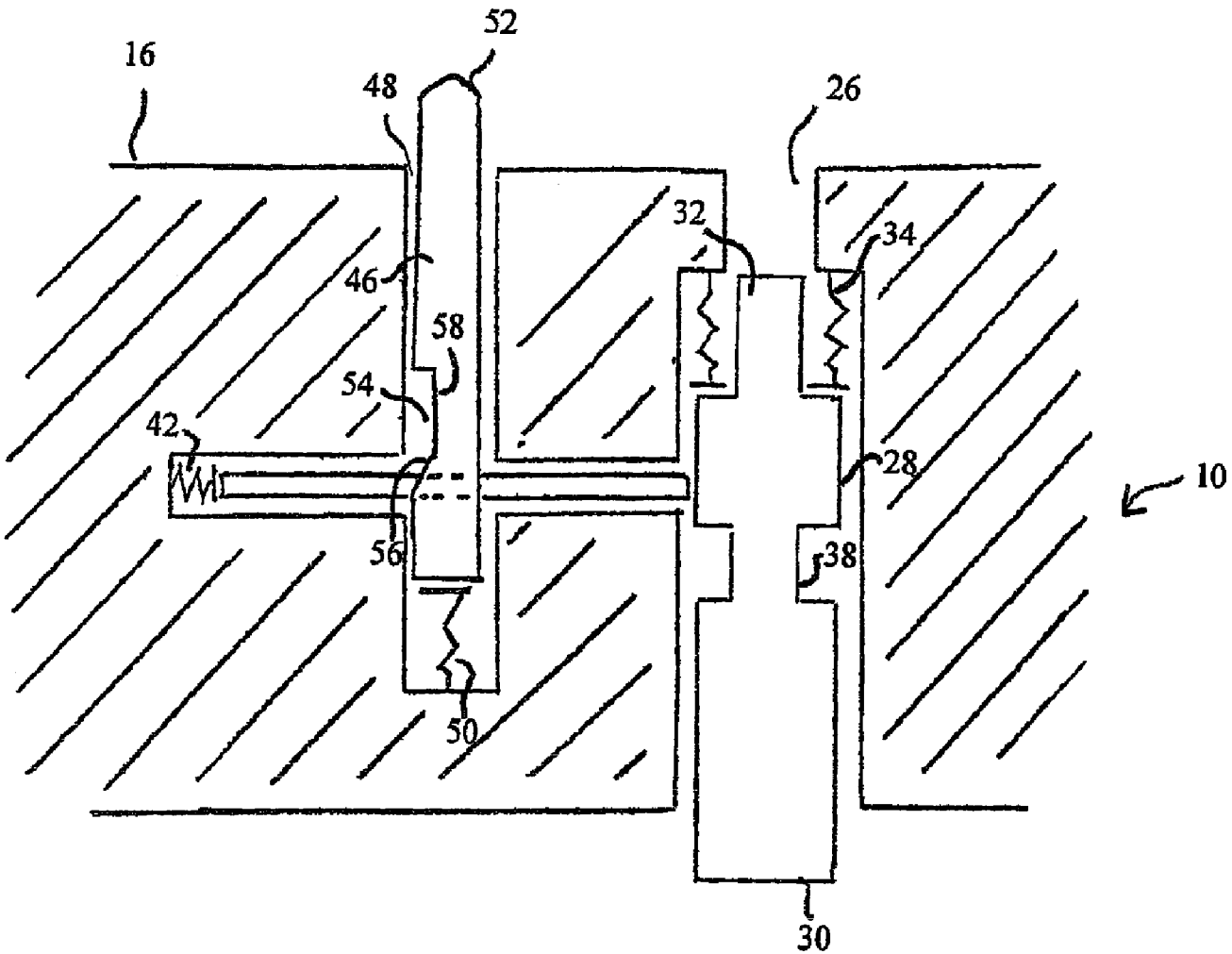
FIG. 7 is a schematic illustration of the inventive device in the ready-to-lock state.

The coupling part 100 has a pin 114 which is movably mounted in a bore 116 which is formed in a lateral face 118, as can be seen in the perspective view according to FIG. 3 and in particular the schematic illustrations according to FIGS. 5 to 7.

The pin 114 is biased via a first pressure-loaded coil spring 120 such that it projects from the lateral face 118 when the coupling parts 10 and 100 are not connected to each other.

In the lateral wall 16 of the first coupling part 10, a bore 26 adapted to the pin 114 is formed. As shown in FIGS. 5 to 7, an unlocking element 28 is arranged in the bore 26. The unlocking element 28 comprises a push button 30 and a shaft 32, as can in particular be taken from FIG. 4, in which a part of the components of the above-mentioned mechanism arranged on the first coupling part is shown. The push button 30 is substantially formed as a hollow cylinder. This hollow cylinder is open at the end facing the interior of the box-shaped body 14 and closed at the end opposite to the interior of the body 14. This closed end is shown in FIG. 1.

The unlocking element 28 is resiliently biased via a second pressure-loaded coil spring 34 into a locking position in which the shaft 32 is countersunk in the bore 26. In this locking position, a portion of the bore 26 facing the interior of the box-shaped body 14 remains free. The part of the pin 114 projecting from the sidewall 118 of the second coupling part 100 can engage this portion of the bore 26.

Figure 4:
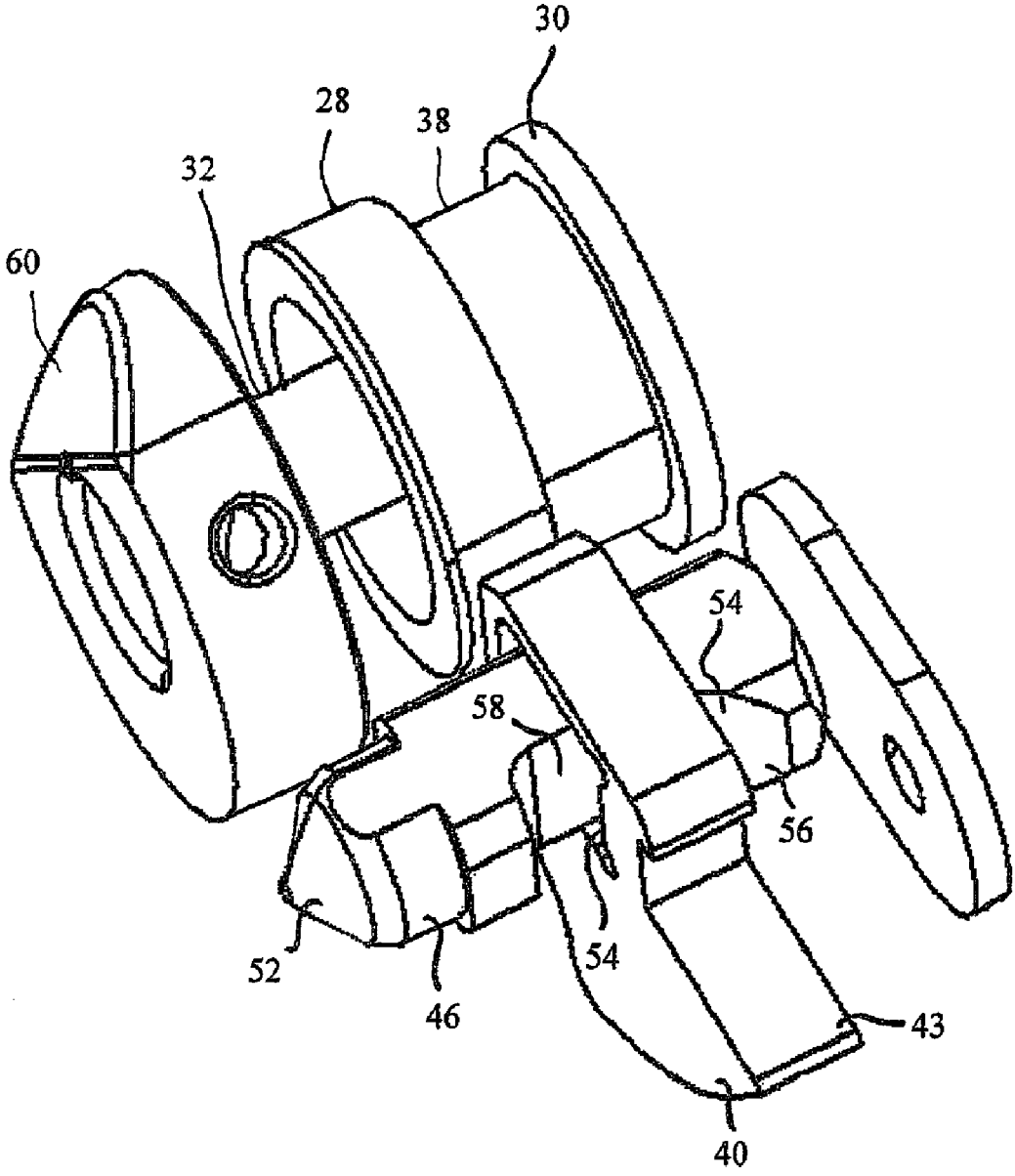
FIG. 4 is a perspective view of some components of the mechanism for locking and unlocking.

So that the coil spring 32 biases the unlocking element 28 into its locking position, i.e. in FIG. 4 (in which inter alia the coil spring has been omitted) towards the upper right-hand side, it can, for example, be arranged such that it surrounds the shaft 32 and is seated with one end in the push button 30 formed as a hollow cylinder, while it bears against a shoulder formed in the bore 26 with its other end. For this purpose, the bore 26 is, for example, stepped (see FIGS. 5 to 7).

As shown in FIG. 4, the push button 30 has an annular groove 38 in its outer surface, which groove is perpendicular to the cylinder axis of the push button 30. The groove 38 is adapted to engage a catch element 40 when the unlocking element 28 is pushed into an unlocking position, i.e. downwards towards the left-hand side in FIG. 4. The catch element 40 is mounted such that it is immovable parallel to the cylinder axis of the push button 30 formed as a hollow cylinder, but is movable perpendicular to the cylinder axis. The catch element 40 is pressed onto the outer surface of the push button 30 by a third pressure-loaded coil spring 42 not shown in FIG. 4. As particularly shown in FIG. 1, the catch element 40 has an actuating section 43 which can be manually actuated by the operator.

The catch element 40 has a recess 44 through which a release element in the form of a bolt 46 is passed. The bolt 46 is mounted in a further bore 48 parallel to the cylinder axis of the push button 30. Via a fourth coil spring 50, which is seated in the bore 48 and is pressure-loaded, the bolt 46 is biased into a first position in which it projects into the box-shaped body 14 with a tapered end 52, as is shown inter alia in FIG. 2. The bolt 46 can be moved against the spring force exerted by the fourth coil spring 50 into a second position, in which it is countersunk in the bore 48.

At the bolt 46, a recess 54 is formed which has a section 56 that is inclined with respect to the cylinder axis of the push button 30 and a section 58 which is parallel to the cylinder axis mentioned and which borders the inclined section 56 towards the end 52 of the bolt 46. The inclined section 56 serves as a bearing surface by which the catch element 40 is disengaged from the groove 38, as will be explained in more detail further below.

As illustrated in FIG. 2, the bores 26, 48 and thus the unlocking element 28 and the bolt 46 are arranged in the lower region of the body 14. The sidewall 16 has on its inside a section 60 which borders the bore 26 towards the open side of the body 14 and forms a beveled sliding surface for the pin 114.

In the following, it is successively described how the accessory 12 is mounted on the operating table 102, is locked thereat, is again unlocked and finally removed.

At first, the first coupling part 10 is fitted with the rod 24 into the rod receptacle 112 of the second coupling part 100, as a result whereof the accessory 12 is connected to the operating table 102. In doing so, the first coupling part 10 is preferably fitted on the second coupling part 100 at an angle with respect thereto so that the lower region of the first coupling part 10 is, at first, still spaced from the second coupling part 100. Then, this lower region of the first coupling part 10 is moved towards the second coupling part 100 in a pivot motion, the pivot axis of which is given by the rod 24 mounted in the rod receptacle 112. In this pivot motion, at first the beveled sliding surface 60 formed on the sidewall 16 of the first coupling part 10 comes into contact with the pin 114. The sliding surface 60 then pushes the pin 114 into the bore 116 against the biasing force exerted by the first coil spring 120. As soon as the first coupling part 10 is pivoted towards the second coupling part 100 so far that the pin 114 and the bore 26 formed in the sidewall 16 of the first coupling part 10 are aligned with one another, the coil spring 120 which is pressured-loaded at this point in time expands and thus pushes the pin 114 into the bore 26. At the same time, the lateral face 118 of the second coupling element 100 abuts on the tapered end 52 of the bolt 46. As a result thereof, the bolt 46 is pushed into the bore 48 against the spring force exerted by the fourth coil spring 50. As soon as the pin 114 and the bore 26 are engaged with one another, the connection between the two coupling parts 10 and 100 is positively locked. This locked state is schematically illustrated in FIG. 5.

In order to unlock the connection between the two coupling parts 10 and 100, the operator pushes the push button 30 of the unlocking element 28 from the outside. The shaft 32 bordering the push button 30 is pressed onto the pin 114 seated in the bore 26 against the spring forces exerted by the coil springs 34 and 120, as a result whereof the pin is pushed out of the bore 26. The unlocking element 28 is moved out of its locking position shown in FIG. 5 and into its unlocking position. As soon as the unlocking position has been reached, the third coil spring 42 presses the catch element 40 into the groove 38 of the push button 30. When the catch element 40 has engaged the groove 38, the unlocking element 28 is kept in the unlocking position against the spring forces exerted by the coil springs 34 and 120. As a result thereof, the positive locking between the pin 114 and the bore 26 is released and the connection of the two coupling parts 10 and 100 is unlocked. This unlocked state is schematically illustrated in FIG. 6.

Starting out from the unlocked state as illustrated in FIG. 6, the first coupling part 10 can be pivoted away from the second coupling part 100 in a motion opposite to the pivot motion performed for locking. As soon as the tapered end 52 of the bolt 46 disengages from the lateral face 118 of the second coupling part 100, the fourth coil spring 50 pushes the bolt 46 out of the bore 48 and into the interior of the box-shaped body 14. During this movement of the bolt 46, which is directed to the lower left-hand side in FIG. 4 and upwards in FIG. 7, the wall of the recess 44 of the catch element 40 comes into contact with the recess 54 formed on the bolt 46 in the region of the inclined bearing surface 56. In its motion, the inclined bearing surface 56 thus disengages the catch element 40 from the groove 38 of the unlocking element 28. As soon as the catch element 40 has been disengaged from the groove 38, the second coil spring 34 pushes the unlocking element 28 again into its locking position, i.e. in the position in which the shaft 32 of the unlocking element 28 is countersunk in the bore 26 and thus, there is space available in the bore 26 for engagement of the pin 114. By removing the first coupling part 10, the inventive device is thus automatically placed into a ready-to-lock state.

The coil springs 34, 42, 50 and 120 used in the present embodiment are to be dimensioned in accordance with the above described functioning. For example, it has to be taken into account that the energy stored in the pressure-loaded fourth coil spring 50 is high enough in order to disengage the catch element 40 from the groove 38 against the spring force exerted by the third coil spring 42.

It is pointed out that the operator can also disengage the catch element 40 from the groove 38 by means of the actuating section 43 when the coupling parts 10 and 100 are connected to each other (see FIG. 1).

While the present invention has been illustrated and described with respect to a particular embodiment thereof, it should be appreciated by those of ordinary skill in the art that various modifications to this invention may be made without departing from the spirit and scope of the present invention.

What is claimed is:

1. A device for releasable mounting of an accessory on an operating table, comprising:

two coupling parts which can be connected to each other, a first one of which is arranged on the accessory and a second one of which is arranged on the operating table, and a mechanism for locking and unlocking the connection between the two coupling parts, characterized in that the mechanism comprises:

a first locking element arranged at the first coupling part and a second locking element arranged at the second coupling part, which can be engaged with one another for locking and be disengaged from one another for unlocking, a manually actuatable unlocking element movably arranged at the first coupling part, wherein the unlocking element is biased into a locking position by a second biasing element and can be moved against the second biasing elements into an unlocking position in which it acts on one of the two locking elements such that the two locking elements are disengaged from one another, a catch element which is movably arranged at the first coupling part and keeps the unlocking element in its unlocking position against the second biasing element, and a release element movably arranged at the first coupling part and biased into a first position by a fourth biasing element and is acted upon by the second coupling part when the coupling parts are connected to each other and is pushed into a second position against the fourth biasing element, the release element acting on the catch element in its first position such that the catch element is disengaged form the unlocking element.

2. The device according to claim 1, wherein the first locking element is a bore and the second locking element is a movably mounted pin, which is resiliently biased via a first biasing element such that it engages the bore when the coupling parts are connected to each other.

3. The device according to claim 2, wherein the unlocking element is slidably mounted in the bore, and has an externally actuatable push button on its end opposite to the pin and a shaft on its end facing the pin, which shaft pushes the pin out of the bore upon actuation of the push button.

4. The device according to claim 3, wherein the push button is substantially formed as a hollow cylinder, the end of which facing the pin is open and the end of which opposite to the pin is closed, the outer surface of the hollow cylinder has an annular groove perpendicular to the cylinder axis, and the catch element is mounted immovably parallel to the cylinder axis and movably perpendicular to the cylinder axis, is resiliently biased via a third biasing element onto the outer surface of the hollow cylinder and is engaged in the groove in the unlocking position of the unlocking element.

5. The device according to claim 4, wherein the release element is a bolt which is movable parallel to the cylinder axis and has a bearing surface that is inclined with respect to the cylinder axis and formed such that, when the catch element is engaged in the groove, the release elements abuts the catch element during the movement of the release from its second position into its first position and as a result thereof disengages the catch element from the groove.

6. The device according to claim 5, wherein the catch element has a recess parallel to the cylinder axis through which the release element is passed, and the bearing surface of the release element abuts on a part of the wall of the recess when the catch element is engaged in the groove of the unlocking elements.

7. The device according to claim 5, wherein the catch element has an externally accessible actuating section, via which the catch element engaged in the groove can be manually disengaged from the groove when the coupling parts are connected to each other.

8. The device according to claim 2, wherein the first coupling part has a box-shaped body which is open on one side and accommodates the second coupling part.

9. The device according to claim 8, wherein the first coupling part has a rod extending between opposite sidewalls in the upper region of the body, the second coupling part has a rod receptacle on its upper surface, into which the first coupling part with its rod can be fitted such that it can be pivoted in the rod receptacle, and the bore forming the first locking element is arranged in the lower region of the body of the first coupling part and the pin forming the second locking element is arranged in the lower region of the second coupling part.

10. The device according to claim 8, wherein the bore forming the first locking element is formed in a sidewall of the first coupling part and a portion of the sidewall bordering the bore towards the open side of the body has a beveled sliding surface for the pin sliding into the bore.

11. The device according to claim 10, wherein the release element is movably mounted in a second bore formed in the sidewall of the body of the first coupling part, and is resiliently biased into its first position via the fourth biasing element such that it projects from the sidewall into the interior of the body, and is pushed into its second position from a lateral face of the second coupling element when the coupling parts are connected to each other.

12. The device according to claim 11, wherein the portion of the release element projecting into the interior of the body of the first coupling part in the first position has a tapered form.

* * * * *